US005652560A

United States Patent [19]

Carter et al.

[11] Patent Number: 5,652,560

[45] Date of Patent: Jul. 29, 1997

[54] EXTENDED LIFE SOLENOID

[75] Inventors: Daniel L. Carter, Scottsville; Geoffrey C. Williams, Penfield, both of N.Y.; Philip A. Billings, Shoreview, Minn.

[73] Assignee: Xerox Corporation, Stamford, Conn.

[21] Appl. No.: 551,604

[22] Filed: Nov. 1, 1995

[51] Int. Cl.[6] ..... H01F 3/00

[52] U.S. Cl. ..... 335/255; 74/21

[58] Field of Search ..... 335/255, 256, 335/257, 136, 137, 138, 139, 140, 123; 74/21

[56] References Cited

U.S. PATENT DOCUMENTS 4,558,293 12/1985 Haneda et al. .

4,636,761 1/1987 Caruso et al. ..... 335/140

5,417,403 5/1995 Shurman et al. .

*Primary Examiner*—Lincoln Donovan

*Attorney, Agent, or Firm*—T. L. Fair

[57] ABSTRACT

A method and solenoid assembly for extending the wear life of the solenoid. These include: enabling rotation of the solenoid plunger within the solenoid housing to expose a new solenoid plunger surface when solenoid plunger surface reaches a failure mode; reducing and/or eliminating side load on the solenoid; reducing the clearance or tolerance between the solenoid housing and the solenoid plunger to reduce solenoid wear; and a stop feature improvement with less stress concentration.

16 Claims, 4 Drawing Sheets

EXTENDED LIFE SOLENOID

BACKGROUND OF THE INVENTION

This invention relates generally to a solenoid, and more particularly concerns extending the life of the solenoid.

As a solenoid assembly wears, the surface between the solenoid plunger and the solenoid housing loses its low friction coating. This loss of low friction coating causes the pull in and drop out times of the solenoid assembly to increase in length eventually translating to a failure in timing or reduced stroke. This loss of low friction coating often occurs on the top and bottom of the plunger surfaces at opposite points as a result of side loads within the solenoid assembly.

The following disclosures may be relevant to various aspects of the present invention and may be briefly summarized as follows:

U.S. Pat. No. 4,558,293 to Haneda et al. discloses a solenoid assembly comprising a magnetic plunger, an electric coil for generating a magnetic flux in a direction along an axis of the magnetic plunger, a main yoke composed of at least two separate members for defining a magnetic flux passage around the electric coil, and a pair of yoke end members held in engagement respectively with opposite ends of the main yoke, an outer casing. The yoke and members have recesses extending substantially normally to the axis of the magnetic plunger, and the main yoke has projections fitted respectively in the recesses to maintain the main yoke and the yoke end members in engaging relationship. The outer casing has an inner wall keeping the main yoke held in engagement with the yoke end members. A leaf spring acts on the main yoke to hold the latter securely in place in the outer casing. The yoke end members have cylindrical projections supporting thereon the electric coil between the projections of the main yoke. Magnetic cores are firmly held against a permanent magnet by resilient members fitted in slots defined in outer peripheral surface of a plunger shaft.

U.S. Pat. No. 5,417,403 to Shurman et al. discloses a solenoid valve including a valve housing having a central bore and a valve seat, a valve element movable between an open position allowing fluid to pass through said valve seat and a closed position in sealing engagement with said valve seat, a valve operator for moving the valve element between the open and closed positions including a reciprocating armature plunger member extending through the bore and an armature secured to the armature plunger, a valve adjustment for adjustably mounting the valve element relative to the valve operator for permitting adjustment to within an acceptable tolerance of a predetermined distance between the valve element and the valve seat when the valve element is in its open position without creating a path of leakage when the valve element is in its closed position. A valve adjustment securing mechanism is provided for securing the armature to an armature end of the armature plunger and a load bearing insert is secured within the armature for bearing a load exerted by the armature plunger during reciprocation of the valve element to allow for surface contact during the valve operation without surface wear.

SUMMARY OF INVENTION

Briefly stated, and in accordance with one aspect of the present invention, there is provided a solenoid assembly comprising: a solenoid plunger having at least two surfaces including a first surface and a second surface, the solenoid plunger having positions including a first position and a second position being operable between the first surface and the second surface, respectively; and means for holding the solenoid plunger, the holding means being operable between the first position and said second position.

Pursuant to another aspect of the present invention, there is provided a method for extending wear life of a solenoid assembly having a surface of a solenoid plunger and a solenoid housing having contact therebetween, the solenoid plunger having multiple surfaces and the solenoid housing having a mating end for coupling with a mounting plate, comprising: machining a locating key circumference about the mating end of the solenoid housing; inserting the mating end of the solenoid housing to the mounting plate having an accommodating mounting hole enabling rotation to multiple locking positions; and rotating the solenoid assembly from one locking position to another locking position to allow contact between the solenoid housing and another surface of the solenoid plunger surface, extending the life of the solenoid assembly.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
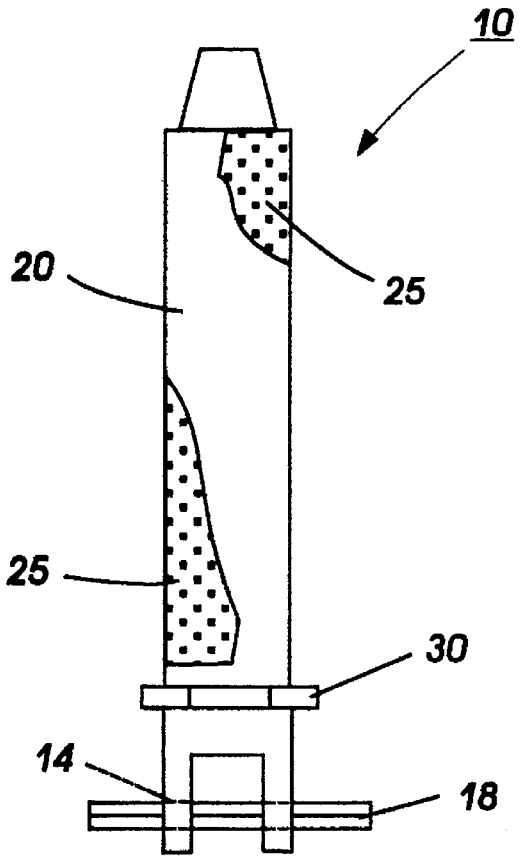
FIG. 1 PRIOR ART
FIG. 1 is a front schematic view of a prior art solenoid plunger with the friction coating worn off in certain areas of the plunger surface.

Reference is now made to FIG. 1, which shows a front view schematic of a prior art solenoid plunger 10 with the coating worn off in certain areas. The solenoid plunger 10 action relative to the solenoid housing 50 (see FIG. 3) can cause solenoid surface coating wear 25 on opposite surfaces of the solenoid plunger 10. In the present invention, when one side or surface of the solenoid plunger 10 wears to the point of high friction, the solenoid plunger 10 is rotated (e.g. by a technical representative or mechanically) to a new wear surface 20 extending the life of the solenoid. In this manner, the present invention allows additional life cycles by the solenoid assembly after an apparent failure to the solenoid plunger 10 has occurred due to high friction.

With continuing reference to FIG. 1, a hole 14 is shown in phantom lines through which a roll pin 18 is inserted to connect the plunger to a member (e.g. actuator) that is being moved. An e-ring 30 is used to dissipate the impact force to the solenoid plunger 10 as it moves in and out of the solenoid housing upon actuation of the solenoid assembly.

Figure 2:
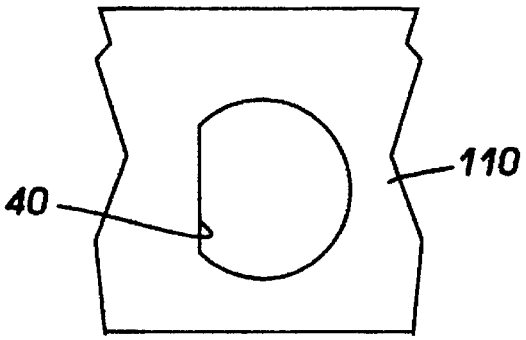
FIG. 2 PRIOR ART
FIG. 2 is a schematic of a prior art "D" shaped solenoid mount hole in the mounting plate of the transfer assist assembly.

Reference is now made to FIG. 2 which shows a schematic of a prior art "D" shaped solenoid mounting hole in the mounting plate of a transfer assist assembly. The "D" shaped mounting hole 40 is a locating feature that keys the solenoid housing into the transfer assist assembly. The "D" shaped mounting hole 40 locating feature, is a common configuration for holding a solenoid assembly in a mounting plate 110. The "D" shaped mount hole 40 limits the solenoid assembly to one position for mounting. The present invention discloses the use of a two or more position solenoid, to give multiple wear surfaces, thus extending the life of the solenoid assembly.

As a solenoid plunger wears, it loses its low friction coating. This causes the pull in and drop out times of the solenoid plunger inside the solenoid housing to get longer and more variable and, eventually reach some failure in timing, variability, or reduced stroke. This wear can occur in two locations 25 on the top and the bottom of the plunger 10, but on opposite sides of the solenoid surface, as shown in FIG. 1. This is caused by side loads within the solenoid assembly. In the present invention, at the point of failure, the solenoid plunger 10 is rotated, providing a new solenoid wear surface. The solenoid is then free to operate again extending the life of the solenoid assembly.

Testing has shown that a failed solenoid plunger 10 can be brought back into specification by rotating the solenoid as in the present invention. The drop out time of a new solenoid plunger 10 is approximately 25 msec. for the actuator to go to home position. (The drop out time is the time from when the voltage is turned off to the solenoid plunger being pulled back to the out position (i.e. home position by a return spring.) At failure, the drop out time was approximately 100 msec. Rotating this same solenoid 180 degrees, provides a new wear surface for the solenoid, thereby reducing the drop out time from approximately 100 msec to approximately 33 msec. This reduction in drop out time brings the drop out time relatively close to the initial drop out time (e.g. about 25 msec) of a new solenoid. This is the result, if the failure mode was slow dropout time. If the failure is reduced stroke, the dropout will be low at failure, but have 20–30 msec. variability in 15 samples. Rotate the solenoid housing 180 degrees and the dropout will go up slightly, but have variability in 15 samples of only 1–2 msec. The solenoid life will be increased another 4 million cycles.

Figure 4:
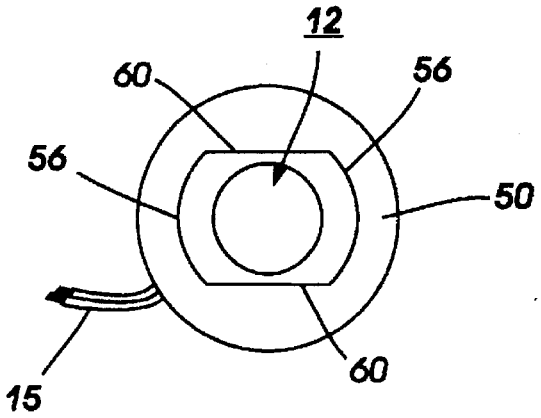
FIG. 4 is a top view of the present invention having two flat sides about the solenoid opening in the solenoid housing.

Reference is now made to FIG. 4 which shows a top schematic view of an embodiment of the present invention. In this embodiment, the portion of the solenoid housing 50 to be inserted into the transfer assist assembly mounting plate includes two flat surfaces 60 connected by two convex surfaces 56 opposite one another. The solenoid housing 50 can be machined into this "double D" configuration (e.g. two flat sides 60 connected on either end to one another by a semicircle or convex arc 56) to permit the solenoid housing 50 to be rotated 180 degrees from one locking position to another. This 180 degree rotation enables the solenoid plunger 10 (see FIG. 6) to place a new, non-worn surface 20 (see FIG. 1) into contact with the rotating mechanism (e.g. actuator) which extends the solenoid life, as the plunger engages in the up and down action of the solenoid assembly. It is noted that the degree of rotation for a new solenoid surface is not limited to 180 degrees. (i.e. The solenoid housing 50 can be configured with a multiple position locating feature that enables other degrees of rotation as long as a non-worn surface of the solenoid plunger is positioned relative to the solenoid housing 50 to extend the solenoid assembly life.) It is further noted that the solenoid plunger can be rotated to a new non-worn surface independent of the solenoid housing.

Figure 3:
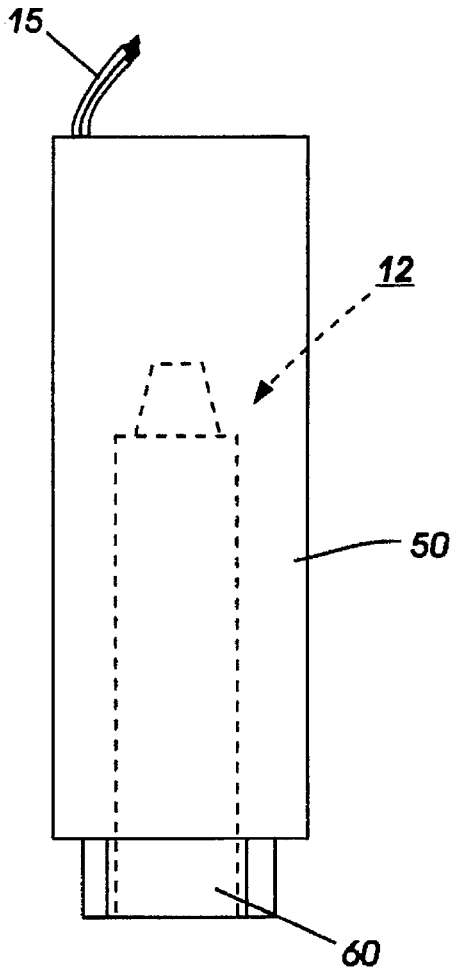
FIG. 3 shows a schematic side view of the solenoid plunger (in phantom lines) inserted into the solenoid housing.

FIG. 3 shows a side schematic view of the present invention shown in FIG. 4. The solenoid plunger cavity 12 is shown, in phantom lines, in the solenoid housing 50. The flat surfaces 60 of the solenoid housing for multiple lock positions are also indicated. A voltage lead 15 from the solenoid coil is used for actuation of the solenoid.

Another element of the present invention for extending the life of a solenoid assembly includes reducing the tolerance between the solenoid plunger and the solenoid housing. Rotation of the solenoid plunger to a new surface and a tighter tolerance between the solenoid plunger and the solenoid housing can further prolong the life of the solenoid assembly. The tighter tolerance between the solenoid plunger and the solenoid housing reduces side load that is a common cause of solenoid assembly failure.

In a high load dual voltage solenoid, the solenoid plunger side wall clearance is very important. In high load solenoids, the failure mode of the solenoid is the wearing out of the sidewall by side loads in the solenoid. Magnetic flux crossing any air gap exerts a magnetic force inversely proportional to the size of the air gap. This magnetic flux crossing between the plunger and the solenoid assembly will always bias the plunger toward one side of the solenoid assembly resulting in a small gap on the bias side and a large gap on the opposite side. The more clearance between the solenoid housing and the solenoid plunger, the greater the side force differential on one side. Hence, one side load has approximately zero gap and the other side has the remainder of the gap clearance between the solenoid plunger and the solenoid inner housing, which causes a large side force differential and leads to a large side load. Hence, as the clearance gets less, the side load becomes lower and causes less wear on the plunger, leading to longer solenoid life.

Figure 6:
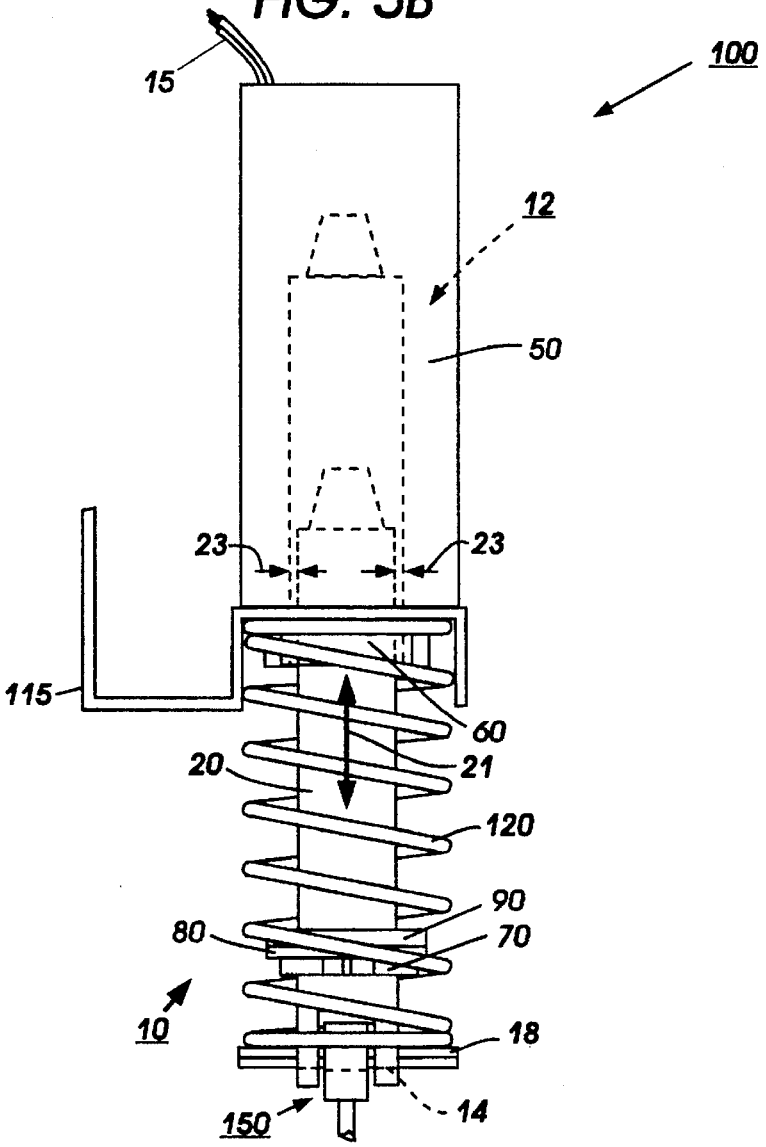
FIG. 6 is a side elevation of the present invention.

In the present invention, the solenoid plunger has less room to move, thereby reducing the differential side force and the resulting amount of wear to the solenoid plunger and interior of the solenoid housing. The use of less than or equal to 0.005" side wall clearance, in the present invention, reduced the impact of side loads on the wear occurring between the sidewall and the solenoid plunger. This reduction in wear improved the life of the solenoid assembly. This reduction in side wall clearance to less than or equal to approximately 0.005", is less than the industry standard of approximately 0.010" to 0.020". Furthermore, this reduction in side wall clearance is viewed as moving the clearance in the opposite direction from what is logical by industry standard to improve the life of the solenoid. The industry practice would be to slightly increase the clearance (e.g. tolerance) to enable debris to escape in order to improve solenoid life. While this philosophy may work in low load solenoids, the present invention shows that just the opposite is required when using a high load dual voltage solenoid. The reduced clearance, of the present invention, in a high load dual voltage solenoid reduces the detrimental impact of the solenoid plunger against the solenoid housing due to side loads. Testing has shown that a 0.010" plunger gap (i.e. play about the plunger in the housing) gives a life of 10 million actuations while a 0.005" total plunger gap, gives a life greater than 19 million actuations to the solenoid assembly. See reference numeral 23 of FIG. 6 showing a 0.025" (i.e..005"/2) gap on either side of the solenoid plunger for a total plunger gap of 0.005". (The ideal situation would be zero gap but this is not realistic since some clearance must exist for the solenoid plunger to move up and down in the solenoid housing.)

Another source of side loads is the interaction between the solenoid plunger and the attached rotating mechanism (e.g. actuator 150, see FIG. 6). In standard practice, the contact angle between the plunger and the rotating mechanism, as well as the direction of the reactive force on the solenoid plunger, change generating side loads of significant magnitude and variability.

Another embodiment for reducing or eliminating these side loads in the present invention involves the use of a constant contact angle, between the solenoid plunger and a rotating mechanism, (e.g. actuator) through forward or return strokes to counteract friction and to maintain the direction of the reactive force parallel to the direction of plunger travel. For a given curvature and matching coefficient of friction, the side load is zero no matter what the magnitude of load. This aspect of the present invention is not limited to solenoids, but is applicable to any actuator that can have side loads.

Side loads are the major failure mode in a long term life test. Especially when a high load solenoid is used because of the resulting high side loads that occur. Presently, the plunger moves linear and rotates an actuator, which causes side loads by rotating through an angle. As the solenoid pulls the plunger in, the reaction force starts out, for example, at −2 degrees in the vertical direction and changes to −12 degrees in the vertical direction, in a solenoid that is mounted vertically. This causes a significant shift in the side load (e.g in this example, the shift is 40%) from one direction to the other. In the prior art, the solenoid force changes with the stroke and, the angle of contact changes with rotation. This gives large fluctuations in a changing contact angle mechanism in the prior art. In the present invention, this change in solenoid force, with the stroke, will have no effect on the side loads as it does in the prior art.

In this alternate embodiment for reducing side loads the objective is to eliminate the side loads. To accomplish the elimination of side loads, this embodiment discloses a curved device that eliminates the change in the tangential angle of contact between the solenoid plunger and the rotating mechanism and match the given coefficient of friction. The angle is determined by balancing the coefficient of friction and the angle of contact with the solenoid plunger and the rotating mechanism. The friction between the surfaces causes the side load to be eliminated, if the angle of contact between is equal to the inverse tangent of the coefficient of friction (i.e. contact angle=$\Theta$=tan−1$\mu$), throughout the stroke. For this alternate embodiment to be operable, the reaction force of the rotating mechanism must be either a negative angle or a positive angle in the vertical direction throughout the stroke.

Another element of the preferred embodiment of the present invention is the use of a rigid washer and a grip ring in a high load solenoid to enlarge impact load area and improve bottoming feature life. The rigid washer and grip ring replace the e-ring 30 shown in FIG. 5A. The use of a grip ring and rigid washer improves reliability by dissipating the force of the impact load of the plunger over a larger area using the washer, and the stress concentrations are significantly reduced in the grip ring. This is especially important as the speeds (i.e. ppm) of printers and copiers continue to increase. In high load fast solenoids, for example, operating at speeds of 180 ppm, the impact load of the solenoid bottoming feature is approximately two times more than the same solenoid at 135 ppm speeds.

Figure 5A:
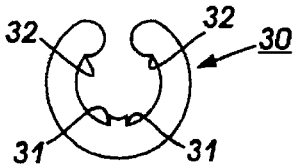
FIG. 5A PRIOR ART
FIG. 5A is a schematic of the prior art e-ring shown in FIG. 1.

A bottoming or stop feature for a plunger commonly uses an e-ring 30 with a plastic cushion washer 90 (see FIGS. 5A and 6). Reference is now made to FIG. 5A which shows a schematic of an e-ring 30. The sharp radii 31, 32 of the e-ring 30 configuration make the e-ring 30 highly susceptible to failure under high impact loads.

Figure 5B:
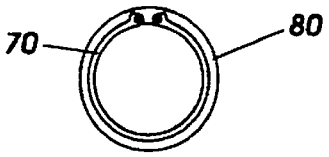
FIG. 5B is a schematic of the grip ring and rigid washer embodiment on the solenoid plunger.

In the preferred embodiment of the present invention, a high load grip ring 70, as shown in FIG. 5B, is used instead of an e-ring. The grip ring 70 has a wide body construction and large radii for improved impact loading (approximately five times stronger than an e-ring). A rigid (e.g. metal, ceramic, plastics) washer 80 is also used to increase the surface area contact of the impact load on the plastic cushion washer 90 (see FIG. 6).

Reference is now made to FIG. 6, side elevation of the present invention. The direction of motion of the plunger 10 in and out of the solenoid housing 50 is shown by arrow 21. A compression spring 120 about the solenoid plunger 10 compresses and expands for the solenoid plunger direction of movement shown by arrow 21. The spring 120 movement is operated by the actuator 150. Life testing of the rings has shown that the e-ring design averages about 2.5 million cycles and the grip ring with the rigid washer can reach greater than 30 million cycles.

It is further noted that without the use of a ring (e.g. grip ring or e-ring) and relying instead upon the solenoid plunger bottom in the solenoid assembly (containing the electrical components), debris accumulates in the bottom of the solenoid at approximately two million cycles. This debris accumulation would further cause the solenoid plunger to "stick" upon its retraction motion from the closed end of the solenoid housing. This will cause a large fluctuation in the return time which is undesirable. The present invention prevents this from occurring. (It is noted that the wear on the inside of the solenoid housing relative to the friction wear on the plunger reduces the number of additional cycles possible to about 4 million more cycles or approximately a 13% increase in life.)

Figure 7:
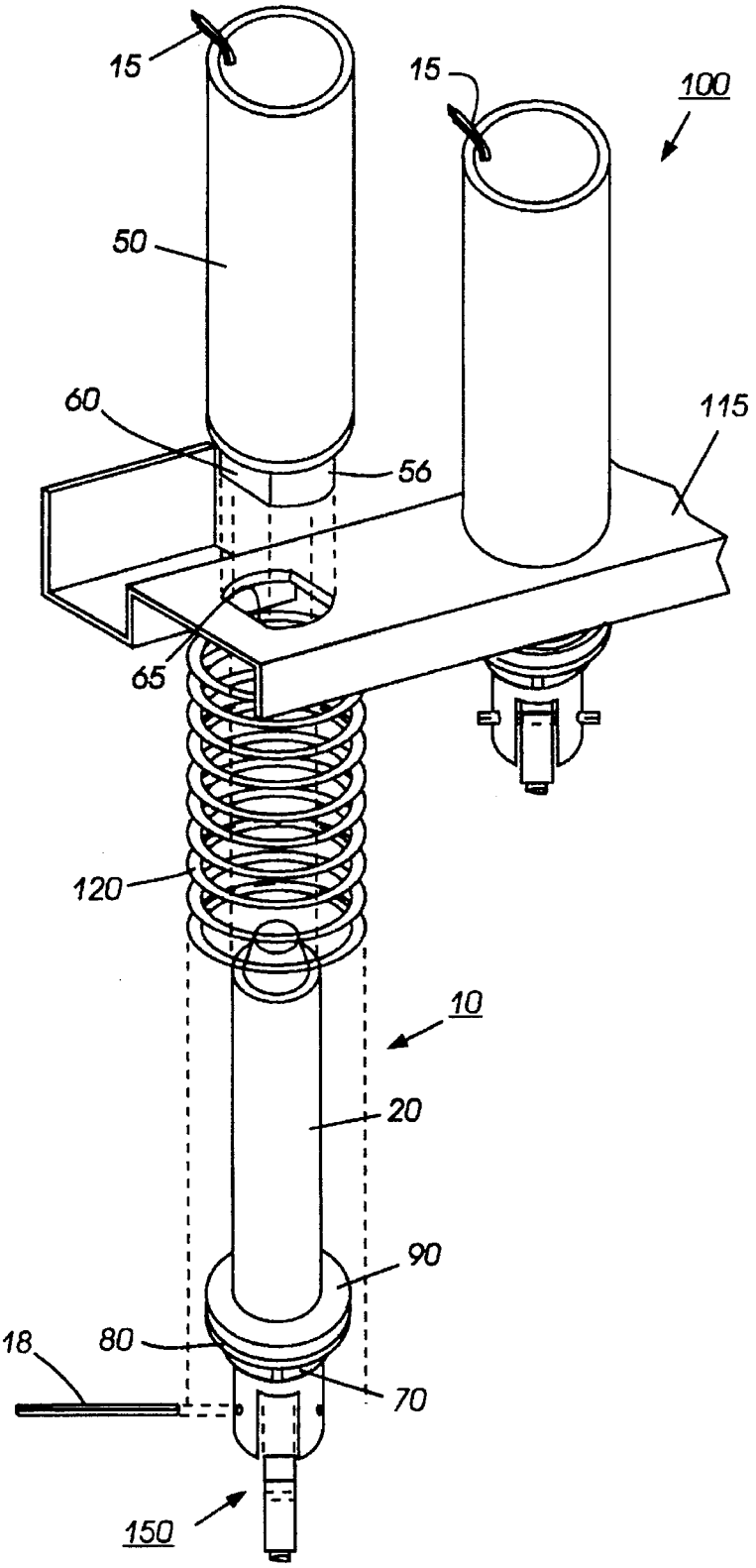
FIG. 7 is an exploded isometric view of the present invention.

Reference is now made to FIG. 7, which shows an isometric exploded view of the present invention. The solenoid mount hole 65, having two flat portions connected by two arcuate portion as a locating key, is located in the mounting plate 115. The locating key end of the solenoid housing 50 is coupled to the mounting hole 65. Alternatively, the locating key end of the solenoid housing of the present invention can be coupled to the "D" shaped mounting hole 40 shown in FIG. 2, for multiple locking positions. FIG. 7 also shows a solenoid assembly 100 mounted on the mounting plate 115 in a closed (i.e. non-exploded) position. One or more solenoid assemblies of the present invention can be mounted on a mounting plate, for example as in a transfer assist assembly, as needed.

In recapitulation, the apparatus for extending the life of a solenoid includes changing the configuration of the solenoid assembly to enable multiple position locking. Multiple positioning enables extended life of the solenoid by providing a new surface via rotation to another position when the initial solenoid plunger surface has failed. Further embodiments of the present invention enhance extended solenoid life. One such embodiment is the removal or reduction of side load in the solenoid assembly. One such embodiment involves decreasing the tolerance or clearance between the solenoid plunger and the solenoid housing. The side load is reduced thus extending wear life of the solenoid. An alternate method for reducing or removing side load in the present invention is to eliminate the friction between the surfaces of the solenoid assembly by making the angle of contact between the solenoid plunger and the rotating mechanism equal to the inverse tangent of the coefficient of friction. Another embodiment of the present invention is the use of a rigid washer and a grip ring in a high load solenoid to increase the impact load area and improve the bottoming feature (i.e. stop mechanism) life. It is noted that each of these embodiments alone will improve the solenoid life to some extent, however, maximum benefit is achieved when these features are combined.

It is, therefore, apparent that there has been provided in accordance with the present invention, an extended life solenoid that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A solenoid assembly comprising:

a solenoid plunger having at least two surfaces including a first surface and a second surface, said solenoid plunger having positions including a first position and a second position being movable between the first surface and the second surface, respectively;

means for holding said solenoid plunger, said holding means being operable between said first position and said second position; and a rotating mechanism being adjacent to said solenoid plunger having an angle therebetween, the angle being equal to the inverse tangent of a coefficient of friction between said solenoid plunger and said rotating mechanism and the angle maintaining constant contact of the angle between said solenoid plunger and said rotating mechanism to remove a source of side loading from the solenoid assembly.

2. A solenoid assembly as recited in claim 1, wherein said holding means comprises a solenoid housing having an interior surface and an exterior surface opposed from one another.

3. A solenoid assembly as recited in claim 2, wherein the first position comprises the first surface being positioned for wear contact with the interior surface of said solenoid housing during operation of the solenoid assembly.

4. A solenoid assembly as recited in claim 3, wherein the second position comprises the second surface being positioned for wear contact with the interior surface of said solenoid housing during operation of the solenoid assembly.

5. A solenoid assembly as recited in claim 4, wherein said solenoid housing comprises a rotatable receptacle for holding said solenoid plunger, said receptacle having two ends including a first end and a second end opposite one another, the first end defining an opening in said receptacle and the second end being closed, said solenoid plunger being inserted through the first end.

6. A solenoid assembly as recited in claim 5, wherein the opening of the first end enables said solenoid plunger to move in and out of said solenoid housing during operation of the solenoid assembly.

7. A solenoid assembly as recited in claim 6, wherein the opening of the first end of said receptacle having a circumference creating a locating key for mounting the solenoid assembly, the circumference of the opening of the first end having two flat surfaces parallel to one another being connected on either end to the other of the flat surfaces by convex arcuate surfaces.

8. A solenoid assembly as recited in claim 7, wherein the first end of said receptacle is mated to a mounting plate, said mounting plate having an opening to accommodate the locating key of the solenoid assembly enabling rotation of the solenoid housing to multiple lock positions.

9. A solenoid assembly as recited in claim 8, wherein said solenoid housing rotates from the first position to the second position simultaneously moving said solenoid plunger from the first surface to the second surface extending wear life of the solenoid assembly.

10. A solenoid assembly as recited in claim 9, wherein said solenoid housing being in a lock position is rotated 180 degrees, when the first surface is located 180 degrees opposite the second surface of said solenoid plunger, forming a different lock position.

11. A solenoid assembly as recited in claim 2, wherein the surface of said solenoid plunger and the interior surface of the solenoid housing have clearance therebetween, the clearance being about 0.005 inches or less to reduce side load on the solenoid assembly.

12. A solenoid assembly as recited in claim 11, wherein said rotating mechanism comprises an actuator.

13. A solenoid assembly as recited in claim 6, wherein said solenoid plunger comprises a non-inserted end and an inserted end opposite one another, said non-inserted end having a stop mechanism.

14. A solenoid assembly as recited in claim 13, wherein said stop mechanism comprises:

a grip ring spaced away from the first end of said solenoid housing for improved impact loading; and a rigid washer located between said grip ring and the first end of said solenoid housing to increase surface area contact of the impact loading.

15. A solenoid assembly as recited in claim 14, wherein said stop mechanism further comprises a pliable washer located between said rigid washer and the first end of said solenoid housing.

16. A method for extending wear life of a solenoid assembly having a surface of a solenoid plunger and a solenoid housing having contact therebetween, the solenoid plunger having multiple surfaces and the solenoid housing having a mating end for coupling with a mounting plate, comprising:

machining a locating key circumference about the mating end of the solenoid housing;

inserting the mating end of the solenoid housing to the mounting plate having an accommodating mounting hole enabling rotation to multiple locking positions;

rotating the solenoid assembly from one locking position to another locking position to allow contact between the solenoid housing and another surface of the solenoid plunger surface, extending the life of the solenoid assembly; and removing side loads from the solenoid assembly by rotating an actuator adjacent to the solenoid plunger having an angle therebetween, the angle being equal to the inverse tangent of a coefficient of friction between the solenoid plunger and the actuator and maintaining constant contact of the angle between the solenoid plunger and the actuator.

* * * * *